US011268377B2

(12) United States Patent
Wang et al.

(10) Patent No.: US 11,268,377 B2
(45) Date of Patent: Mar. 8, 2022

(54) MEASUREMENT-WHILE-DRILLING METHOD AND DEVICE FOR OBTAINING COAL SEAM GAS PARAMETER

(71) Applicant: CHINA UNIVERSITY OF MINING AND TECHNOLOGY, Xuzhou (CN)

(72) Inventors: Enyuan Wang, Xuzhou (CN); Zhonghui Li, Xuzhou (CN); Jianchun Ou, Xuzhou (CN); Liming Qiu, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 85 days.

(21) Appl. No.: 16/618,171

(22) PCT Filed: Nov. 27, 2017

(86) PCT No.: PCT/CN2017/113141

§ 371 (c)(1),
(2) Date: Nov. 29, 2019

(87) PCT Pub. No.: WO2019/071756

PCT Pub. Date: Apr. 18, 2019

(65) Prior Publication Data

US 2020/0116016 A1 Apr. 16, 2020

(30) Foreign Application Priority Data

Oct. 12, 2017 (CN) ..... 201710945411.1

(51) Int. Cl.
*E21B 47/14* (2006.01)
*E21B 47/07* (2012.01)
*E21B 47/26* (2012.01)

(52) U.S. Cl.
CPC ..... *E21B 47/14* (2013.01); *E21B 47/07* (2020.05); *E21B 47/26* (2020.05)

(58) Field of Classification Search
CPC ..... E21B 47/14; E21B 47/07; E21B 47/26
See application file for complete search history.

(56) References Cited

U.S. PATENT DOCUMENTS 6,883,610 B2 * 4/2005 Depiak ..... E21B 33/124 166/177.5
2001/0042643 A1 * 11/2001 Krueger ..... E21B 17/1014 175/73

(Continued)

FOREIGN PATENT DOCUMENTS

CN 101514926 A 8/2009
CN 201412183 Y 2/2010

(Continued)

*Primary Examiner* — Christopher J Sebesta
(74) *Attorney, Agent, or Firm* — Soroker Agmon Nordman Pte Ltd

(57) ABSTRACT

Disclosed are a measurement-while-drilling method and device for obtaining a coal seam gas parameter applicable to measurement of a coal seam gas/coal seam methane parameter while drilling and evaluation of gas drainage performance. The invention performs a measurement-while-drilling operation to obtain information about downhole gas and a coal seam, thereby realizing on-site measurement of a coal seam gas parameter while drilling. The measurement-while-drilling device for obtaining a coal seam gas parameter comprises a compartment (17), a pressure sensor (15), a temperature sensor (14), a flow sensor (4), an acoustic emission sensor (16), a monitoring and control module (11), a power module and a communication module. The device is installed between a drill bit (1) and a first drill pipe (20). The method comprises: in a drilling process, using the temperature sensor (14) to monitor, in real time, a temperature at a spot under measurement; when drilling stops, sealing a borehole to form a pressure measurement cavity, and using the pressure sensor (15) to monitor a gas pressure in real time; after completion of the pressure measurement, (Continued)

using the flow sensor (4) to monitor, in real time, an amount of gas emitted from the borehole; and performing comprehensive calculation to obtain a gas pressure, a gas content, and an amount of initially desorbed gas at the spot of the coal seam. The invention can perform on-site measurement while drilling and calculate to obtain a coal seam gas/coal seam methane parameter, can perform on-site measurement while drilling without sampling, and can use multiple parameters to perform synchronous measurement.

3 Claims, 1 Drawing Sheet

(56) References Cited

U.S. PATENT DOCUMENTS

| | | | | |
|---|---|---|---|---|
| 2007/0257812 | A1* | 11/2007 | Lasater | E21B 47/12 340/854.8 |
| 2008/0115971 | A1 | 5/2008 | Kelleher et al. | |
| 2010/0212891 | A1* | 8/2010 | Stewart | E21B 47/09 166/250.12 |
| 2014/0027112 | A1 | 1/2014 | Irani et al. | |
| 2014/0354081 | A1* | 12/2014 | Li | E21B 41/0085 307/126 |
| 2016/0053597 | A1* | 2/2016 | Brown | E21B 43/26 166/250.1 |
| 2016/0348478 | A1* | 12/2016 | Goodman | E21B 41/0085 |
| 2017/0002646 | A1* | 1/2017 | Bonavides | E21B 49/10 |
| 2018/0283171 | A1* | 10/2018 | Bhongale | E21B 47/07 |

FOREIGN PATENT DOCUMENTS

| | | | |
|---|---|---|---|
| CN | 101775980 | A | 7/2010 |
| CN | 102230375 | A | 11/2011 |
| CN | 103061753 | A | 4/2013 |
| CN | 203772304 | U | 8/2014 |
| CN | 204101535 | U | 1/2015 |
| EP | 2721433 | A1 | 4/2014 |
| WO | 2016074038 | A1 | 5/2016 |

* cited by examiner

MEASUREMENT-WHILE-DRILLING METHOD AND DEVICE FOR OBTAINING COAL SEAM GAS PARAMETER

TECHNICAL FIELD

The present invention relates to a measuring method and device for obtaining coal seam gas parameter, in particular to a measuring method and device applicable for obtaining coal seam gas parameters while drilling, and belongs to the field of coal field gas geology, gas/coal seam gas extraction and coal mine safety.

BACKGROUND

Coal seam gas occurrence, coal seam gas resource evaluation, coal seam gas extraction, coal seam gas development, risk prediction of coal seam gas outburst, and gas disaster control and effect evaluation, etc. involve the measurement of coal seam gas parameter. At present, sampling measurement is mainly used for parameter measurement such as content of coal seam gas, the initial velocity of gas gushing from borehole is mainly measured while withdrawing the drill bit in a shallow hole in the working face, the coal seam gas pressure is mainly measured with a sealed hole balance testing method, or is obtained through inverse calculation from coal seam gas content. At present, the spot sampling and rapid gas content determination method which is a relatively accurate measuring method for coal seam gas content involves a complex sampling process, and the sampling process while withdrawing the drill bit, sampling time, sampling method, typicality of sampling location, and inverse calculation of initial loss, etc. have relatively great influence on the accuracy of the measurement of coal seam gas content. The rapid measurement for coal seam gas content based on a method of drilling for cuttings, which is widely used presently, is poorer in accuracy of spot sampling, poorer in accuracy of sampling time length, and has higher measuring error. All these methods have drawbacks including inadequate measuring points, poor accuracy in reflecting the distribution of coal seam gas, and being prone to miss maximum value, etc., and can't be used for coal seam gas parameter measurement while drilling. Therefore, it is impossible to measure the gas parameters at the drilling locations while drilling at present.

It is urgent to provide a method and solve the technical problem of measuring coal seam gas parameters on the spot quickly and efficiently in real time while drilling. Such a method has a high application demand and wide application prospects, and is a great revolution to coal seam gas parameter measuring methods.

SUMMARY

Technical Problem: in view of the technical problems in the prior art, the object of the present invention is to provide a device for measuring multiple coal seam gas parameters on the spot in real time while drilling and a method thereof, so as to solve the problems of the existing techniques such as the coal seam gas parameters can't be measured on the spot in real time while drilling, the gas parameter measuring points and data are inadequate, the measuring duration is long, the testing process is complex, and the measuring results can't reflect the actual distribution of coal seam gas comprehensively and accurately, etc.

Technical Scheme: the measurement-while-drilling device for obtaining coal seam gas parameters provided in the present invention comprises a compartment, a pressure sensor, a temperature sensor, an acoustic emission sensor, a borehole sealing module, a flow measuring module, a communication interface, a monitoring and control module, and a power supply compartment that has an electric charging interface and can be removed and mounted quickly, wherein, the measurement-while-drilling device is installed between a drill bit and a drilling inclinometer or a first drill pipe; the compartment is a pipe body that is configured to fix various sensors and modules, is hollow so that water can flow through it, and has a threading hole; the flow sensor, the temperature sensor, the pressure sensor, the acoustic emission sensor, the power supply compartment, and the communication interface are connected to corresponding interfaces of the monitoring and control module respectively, the monitoring and control module comprises a variety of sensors and module interfaces, a data storage unit, a timer, a monitoring and control CPU, and a monitoring and control circuit; the power supply compartment supplies power to the monitoring and control module and the power utilization modules or sensors connected to the monitoring and control module.

The borehole sealing module comprises a borehole sealing capsule wrapped on an external rim of the compartment, a main water circuit switch and a borehole sealing capsule water circuit switch that are mounted on the front end of a hollow water pipe and attain a cut-off effect during borehole sealing; an arc-shaped wear plate is wrapped on the outer side of the borehole sealing capsule;

The monitoring and control module comprises a variety of sensors and module interfaces, a data storage unit, a timer, a monitoring and control CPU, and a monitoring and control circuit; wherein, the sensors comprise a HD-LUGB flow sensor, a GWD90 temperature sensor, a GZY25W pressure sensor, and a GS18 acoustic emission sensor, the sensors are connected in shunt and operate separately from each other without any interference, and they are connected via their interfaces to corresponding interfaces of the monitoring and control module, and have functions of monitoring signal conversion, triggering data acquisition, timing data acquisition, data analysis and control.

The flow measuring module comprises a gas flow hole and a gas circuit switch and a flow sensor that are installed in the gas flow hole.

At least 2 pressure sensors, at least 2 gas flow holes, and at least 2 temperature sensors are provided and evenly distributed on the circumference of the compartment.

A measurement method of the measurement-while-drilling device for obtaining coal seam gas parameter comprises: measuring and calculating coal seam gas parameters automatically while drilling, and monitoring and logging the temperature at a measuring point in real time with the measurement-while-drilling device for obtaining coal seam gas parameter in the process of drilling in a coal seam; sealing the borehole to form a pressure chamber, and monitoring and logging the gas pressure in the pressure chamber in real time, during the time when the drilling is stopped or the first drill pipe is replaced; monitoring the gas discharge flow in the pressure chamber and the gas gushing flow from the borehole in real time after the pressure measurement is finished; calculating the coal seam gas pressure, gas content, and initial amount of desorption gas at the measuring point comprehensively; the specific steps are as follows:

a. installing a drill bit and a drilling inclinometer that can measure and log the position of the drill bit on the front end of the first drill pipe before the drilling in the coal seam is commenced, switching on the power switch of the measurement-while-drilling device and driving the drill bit into the borehole after the drill bit is installed in place; logging water flow $Q_{si}$, pressure $P_i$, temperature $T_i$, and acoustic emission signal $A_i$ in real time after the acoustic emission signal identifying that the first drill pipe starts drilling is detected;

b. keeping the main water circuit switch on the compartment in the ON state so that water flows out from the drill bit to carry out drilling and cuttings discharging normally during normal drilling; controlling the action of the borehole sealing module with the monitoring and control CPU; switching off the main water circuit switch and switching on the borehole sealing capsule water circuit switch so that the high pressure water enters into the borehole sealing capsule after an acoustic emission signal identifying the drilling stop is detected and the withdrawal of the drill bit is completed, wherein, when the water pressure becomes stable and there is no flow, it indicates that the borehole has been sealed by capsule; stopping the water supply, switching off the borehole sealing capsule water circuit switch, and sealing the pressure measurement chamber at the bottom of the hole, so that gas gushes from the borehole wall and thereby the pressure $P_i$ in the pressure measurement chamber at the bottom of the hole is increased continuously; replacing and adding the first drill pipe at the drilling machine during this time; completing the pressure measurement within specified time, switching on the gas circuit switch, and measuring and logging the gas flow $Q_{wi}$ in real time; stopping logging $Q_{wi}$ and switching off the gas circuit switch when the time of the flow measurement is over or when the flow is lower than a preset value; switching on the borehole sealing capsule water circuit switch, so that the borehole sealing capsule contracts and discharges water automatically; feeding water and continuing the drilling after the capsule contracts in place;

c. stopping the drilling when a design position is reached; stopping the acquisition and monitoring of the signals after the measurement of the gas flow parameter is finished and the acoustic emission sensor receives no drilling signal for a long time;

obtaining the parameters or waveform data of various indicators including temperature, pressure, water flow, gas flow, and acoustic emission at different times with the measurement-while-drilling device; calculating and ascertaining the coal seam gas content, gas pressure, and initial amount of desorption gas in the coal seam at different times and different positions with the monitoring and control device, according to the gas pressure and its changes, gas flow, temperature and its change rule in the pressure measurement chamber during the time when the drilling is stopped;

d. withdrawing the first drill pipe, removing the measurement-while-drilling device, and performing data communication, ascertaining the coal seam gas content, gas pressure, and initial amount of desorption gas in the coal seam at different measuring points in the borehole in a computer with reference to the position data of the drilling inclinometer (21) after the communication;

e. repeating steps a-d, performing measurement for the next borehole.

The drill pipe is rotated for 1-2 cycles at a low speed in order to achieve a better sealing effect during the time when the high pressure water enters into the borehole sealing capsule.

The power supply is recharged or the power supply module is replaced before the measurement for the next borehole is commenced.

Beneficial effects: with the technical scheme described above, the device and method in the present invention can directly carry out measurement without sampling, thus, sampling difficulties and any measuring error in the sampling process can be avoided; the device and method provided in the present invention can measure coal seam gas parameters on the spot in real time while drilling, realizes coal seam gas parameter measuring while drilling anytime, anywhere, and solves the problems of existing techniques such as the coal seam gas parameters can't be measured on the spot in real time while drilling, the gas parameter testing points and data are inadequate, the measuring duration is long, the measuring process is complex, and the measuring results can't reflect the actual distribution of coal seam gas comprehensively and accurately, etc. The device has a simple structure, is easy to operate, can attain a good application effect, and has extensive practicability in the technical field.

In the figures: 1—drill bit; 2—borehole sealing capsule; 3—gas circuit switch; 4—flow sensor; 5—gas flow hole; 6—arc-shaped wear plate; 7—borehole sealing capsule water circuit switch; 8—communication interface; 9—electric charging interface; 10—power supply compartment; 11—monitoring and control module; 12—threading hole; 13—main water circuit switch; 14—temperature sensor; 15—pressure sensor, 16—acoustic emission sensor, 17—compartment; 18—pressure measurement chamber; 19—borehole; 20—first drill pipe; 21—drilling inclinometer.

DETAILED DESCRIPTION

Hereunder the present invention will be further detailed in embodiments with reference to the accompanying drawings.

Figure 1:
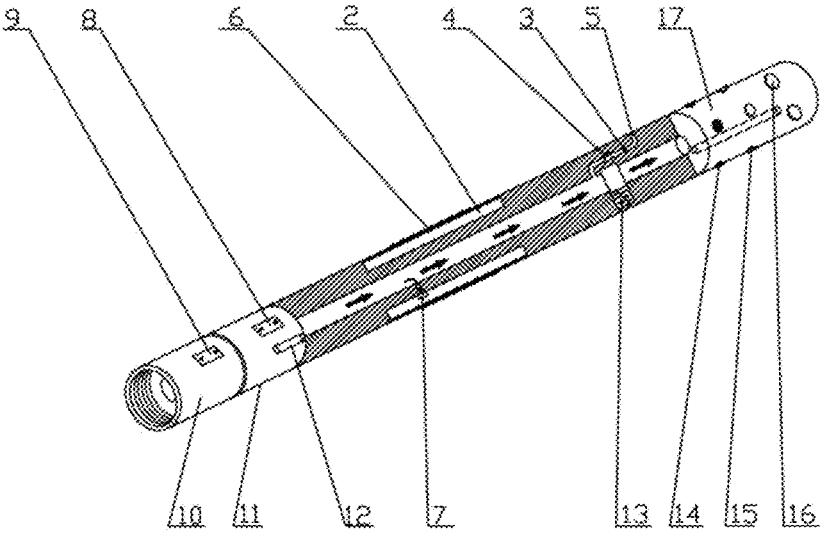
FIG. 1 is a schematic structural diagram of the device provided in the present invention.

As shown in FIG. 1, the measurement-while-drilling device for obtaining coal seam gas parameter provided in the present invention comprises a compartment 17, a pressure sensor 15, a temperature sensor 14, an acoustic emission sensor 16, a borehole sealing module, a flow measuring module, a communication interface 8, a monitoring and control module 11, and a power supply compartment 10 that has an electric charging interface 9 and can be removed and mounted quickly, wherein, the measurement-while-drilling device is installed between a drill bit 1 and a drilling inclinometer 21 or a first drill pipe 20; the compartment 17 is a pipe body that is configured to fix various sensors and modules, is hollow so that water can flow through it, and has a threading hole 12; the flow sensor 4, the temperature sensor 14, the pressure sensor 15, the acoustic emission sensor 16, the power supply compartment 10, and the communication interface 8 are connected to corresponding interfaces of the monitoring and control module 11 respectively, the monitoring and control module 11 comprises a variety of sensors and module interfaces, a data storage unit, a timer, a monitoring and control CPU, and a monitoring and control circuit, the power supply compartment 10 supplies power to the monitoring and control module 11 and the power utilization modules or sensors connected to the monitoring and control module 11.

Figure 2:
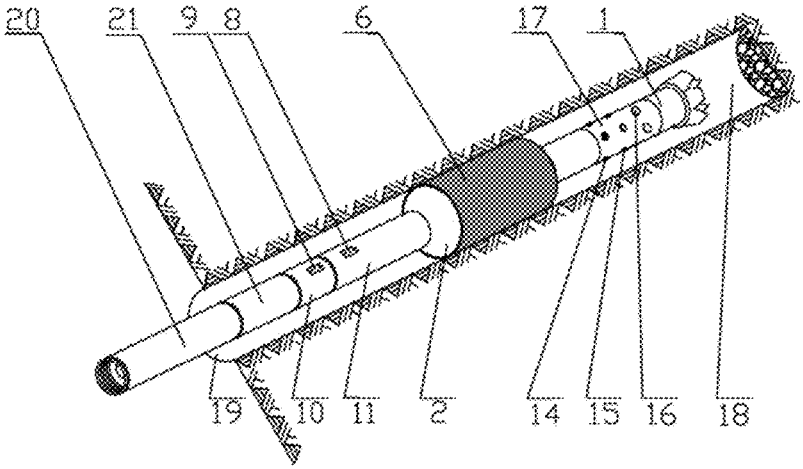
FIG. 2 is a schematic structural diagram of the on-site layout of the device provided in the present invention.

The borehole sealing module comprises a borehole sealing capsule 2 wrapped on an external rim of the compartment, a main water circuit switch 13 and a borehole sealing capsule water circuit switch 7 that are mounted on the front end of a hollow water pipe and attain a cut-off effect during borehole sealing; an arc-shaped wear plate 6 is wrapped on the outer side of the borehole sealing capsule 2, as shown in FIG. 2.

The monitoring and control module comprises a variety of sensors and module interfaces, a data storage unit, a timer, a monitoring and control CPU, and a monitoring and control circuit; wherein, the sensors comprise a HD-LUGB flow sensor, a GWD90 temperature sensor, a GZY25W pressure sensor, and a GS18 acoustic emission sensor, the sensors are connected in shunt and operate separately from each other without any interference, and they are connected via their interfaces to corresponding interfaces of the monitoring and control module, and have functions including monitoring signal conversion, triggering data acquisition, timing data acquisition, data analysis and control;

The flow measuring module comprises a gas flow hole 5 and a gas circuit switch 3 and a flow sensor 4 that are installed in the gas flow hole 5. The model of gas circuit switch is VHS40-04; the model of flow sensor is HD-LUGB.

At least 2 pressure sensors 15, at least 2 gas flow holes 5, and at least 2 temperature sensors 14 are provided and evenly distributed on the circumference of the compartment 17, in order to ensure at least one component is functional while the other component is buried in the coal cuttings under the measurement-while-drilling device. The model of pressure sensors is GZY25W; and the model of temperature sensors is GWD90.

A measuring method of the measurement-while-drilling device for obtaining coal seam gas parameter comprises: measuring and calculating coal seam gas parameters automatically while drilling, and monitoring and logging the temperature at a measuring point in real time with the measurement-while-drilling device for obtaining coal seam gas parameter in the process of drilling in a coal seam; sealing the borehole to form a pressure measurement chamber 18, and monitoring and logging the gas pressure in the pressure measurement chamber 18 in real time, during the time when the drilling is stopped or the first drill pipe 20 is replaced; monitoring the gas discharge flow in the pressure measurement chamber 18 and the gas gushing flow from the borehole in real time after the pressure measurement is finished; calculating the coal seam gas pressure, gas content, and initial amount of desorption gas at the measuring point comprehensively; the specific steps are as follows:

a. installing a drill bit 1 and a drilling inclinometer 21 that can measure and log the position of the drill bit on the front end of the first drill pipe 20 before the drilling in the coal seam is commenced, switching on the power switch of the measurement-while-drilling device and driving the drill bit 1 into the borehole 19 after the drill bit 1 is installed in place, logging water flow $Q_{si}$, pressure $P_i$, temperature $T_i$, and acoustic emission signal $A_i$ in real time after the acoustic emission signal identifying that the first drill pipe 20 starts drilling is detected;

b. keeping the main water circuit switch 13 on the compartment 17 in the ON state so that water flows out from the drill bit 1 to carry out drilling and cuttings discharging normally during normal drilling; controlling the action of the borehole sealing module with the monitoring and control CPU; switching off the main water circuit switch 13 and switching on the borehole sealing capsule water circuit switch 7 so that the high pressure water enters into the borehole sealing capsule 2 after an acoustic emission signal identifying the drilling stop is detected and the withdrawal of the drill bit is completed; rotating the drill pipe for 1-2 cycles at a low speed to achieve a better sealing effect during the time when the high pressure enters into the borehole sealing capsule 2, wherein, when the water pressure becomes stable and there is no flow, it indicates that the borehole has been sealed by the capsule 2; stopping the water supply, switching off the borehole sealing capsule water circuit switch 7, and sealing the pressure measurement chamber 18 at the bottom of the borehole, so that gas gushes from the borehole wall and thereby the pressure $P_i$ in the pressure measurement chamber 18 at the bottom of the borehole is increased continuously; replacing and adding the first drill pipe 20 at the drilling machine during this time; completing the pressure measurement within specified time, switching on the gas circuit switch 3, and measuring and logging the gas flow $Q_{wi}$ in real time; stopping logging $Q_{wi}$ and switching off the gas circuit switch 3 at the end of the flow measurement or when the flow is lower than a preset value; switching on the borehole sealing capsule water circuit switch 7, so that the borehole sealing capsule 2 contracts and discharges water automatically; feeding water and continuing the drilling after the capsule contracts in place;

c. stopping the drilling when a design position is reached; stopping the acquisition and monitoring of the signals after the measurement of gas flow parameter is finished and the acoustic emission sensor 16 receives no drilling signal for a long time;

obtaining the parameters or waveform data of various indicators including temperature, pressure, water flow, gas flow, and acoustic emission at different times with the measurement-while-drilling device; calculating and ascertaining the coal seam gas content, gas pressure, and initial amount of desorption gas in the coal seam at different times and different positions with the monitoring and control device, according to the gas pressure and its changes, gas flow, temperature and its change rule in the pressure measurement chamber 18 during the time when the drilling is stopped;

d. withdrawing the first drill pipe 20, removing the measurement-while-drilling device, and performing data communication, ascertaining the coal seam gas content, gas pressure, and initial amount of desorption gas in the coal seam at different measuring points in the borehole in a computer with reference to the position data of the drilling inclinometer 21 after the communication;

e. repeating steps a-d, performing measurement for the next borehole; recharging the power supply or replacing the power supply module before the measurement for the next borehole is commenced.

The invention claimed is:

1. A measuring method of a measurement-while-drilling device for obtaining coal seam gas parameter, comprising:

providing a measurement-while-drilling device for obtaining coal seam gas parameter, said measurement-while-drilling device comprising:

a compartment (17), a pressure sensor (15), a temperature sensor (14), an acoustic emission sensor (16), a borehole sealing module, a flow measuring module, a communication interface (8), a monitoring and control module (11), and a power supply compartment (10) that has an electric charging interface (9) and can be removed and mounted quickly, wherein, the measurement-while-drilling device is installed between a drill bit (1) and a drilling inclinometer (21) or a first drill pipe (20); the compartment (17) is a pipe body that is configured to fix various sensors and modules, is hollow so that water can flow through it, and has a threading hole (12); the flow sensor (4), the temperature sensor (14), the pressure sensor (15), the acoustic emission sensor (16), the power supply compartment (10), and the communication interface (8) are connected to corresponding interfaces of the monitoring and control module (11) respectively, the power supply compartment (10) supplies power to the monitoring and control module (11) and the power utilization modules or sensors connected to the monitoring and control module (11);

the borehole sealing module comprises a borehole sealing capsule (2) wrapped on an external rim of the compartment, a main water circuit switch (13) and a borehole sealing capsule water circuit switch (7) that are mounted on the front end of a hollow water pipe and attain a cut-off effect during borehole sealing; an arc-shaped wear plate (6) is wrapped on the outer side of the borehole sealing capsule (2);

the monitoring and control module comprises a variety of sensors and module interfaces, a data storage unit, a timer, a monitoring and control CPU, and a monitoring and control circuit;

wherein, the sensors comprise a flow sensor, a temperature sensor, a pressure sensor, and an acoustic emission sensor, the sensors are connected in shunt and operate separately from each other without any interference, and they are connected via their interfaces to corresponding interfaces of the monitoring and control module, and have functions including monitoring signal conversion, triggering data acquisition, timing data acquisition, data analysis and control; the flow measuring module comprises a gas flow hole (5) and a gas circuit switch (3) and a flow sensor (4) that are installed in the gas flow hole (5);

measuring and calculating coal seam gas parameters automatically while drilling, and monitoring and logging the temperature at a measuring point in real time with the measurement-while-drilling device for obtaining coal seam gas parameter in the process of drilling in a coal seam; sealing the borehole to form a pressure measurement chamber (18), and monitoring and logging the gas pressure in the pressure measurement chamber (18) in real time during the time when the drilling is stopped or the first drill pipe (20) is replaced;

monitoring the gas discharge flow in the pressure measurement chamber (18) and the gas gushing flow from the borehole in real time after the pressure measurement is finished;

calculating the coal seam gas pressure, gas content, and initial amount of desorption gas at the measuring point comprehensively; the specific steps are as follows:

a. installing a drill bit (1) and a drilling inclinometer (21) that can measure and log the position of the drill bit on the front end of the first drill pipe (20) before the drilling in the coal seam is commenced, switching on the power switch of the measurement-while-drilling device and driving the drill bit (1) into the borehole (19) after the drill bit (1) is installed in place; logging water flow $Q_{si}$, pressure $P_i$, temperature $T_i$, and acoustic emission signal $A_i$ in real time after the acoustic emission signal identifying that the first drill pipe (20) starts drilling is detected;

b. keeping the main water circuit switch (13) on the compartment (17) in the ON state so that water flows out from the drill bit (1) to carry out drilling and cuttings discharging normally during normal drilling; controlling the action of the borehole sealing module with the monitoring and control CPU; switching off the main water circuit switch (13) and switching on the borehole sealing capsule water circuit switch (7) so that the high pressure water enters into the borehole sealing capsule (2) after an acoustic emission signal identifying drilling stop is detected and the withdrawal of the drill bit is completed, wherein, when the water pressure becomes stable and there is no flow, it indicates that the borehole has been sealed by the capsule (2); stopping the water supply, switching off the borehole sealing capsule water circuit switch (7), and sealing the pressure measurement chamber (18) at the bottom of the borehole, so that gas gushes from the borehole wall and thereby the pressure $P_i$ in the pressure measurement chamber (18) at the bottom of the borehole is increased continuously; adding a drill pipe at the drilling machine during this time; completing the pressure measurement within specified time, switching on the gas circuit switch (3), and measuring and logging the gas flow $Q_{wi}$ in real time; stopping logging $Q_{wi}$ and switching off the gas circuit switch (3) at the end of the flow measurement or when the flow is lower than a preset value; switching on the borehole sealing capsule water circuit switch (7), so that the borehole sealing capsule (2) contracts and discharges water automatically; feeding water and continuing the drilling after the borehole sealing capsule contracts in place;

c. stopping the drilling when a design position is reached; stopping the acquisition and monitoring of the signals after the measurement of gas flow parameter is finished and the acoustic emission sensor (16) receives no drilling signal for a long time;

obtaining the parameters or waveform data of various indicators including temperature, pressure, water flow, gas flow, and acoustic emission at different times with measurement-while-drilling device; calculating and ascertaining the coal seam gas content, gas pressure, and initial amount of desorption gas in the coal seam at different times and different positions with the monitoring and control device according to the gas pressure and its change, gas flow, temperature and its change rule in the pressure measurement chamber (18) during the time when the drilling is stopped;

d. withdrawing the drill pipe, removing the measurement-while-drilling device, and performing data communication; ascertaining the coal seam gas content, gas pressure, and initial amount of desorption gas in the coal seam at different measuring points in the borehole in a computer with reference to the position data of the drilling inclinometer (21) after the communication;

e. repeating steps a-d, and performing the measurement for an additional borehole.

2. The measuring method of the measurement-while-drilling device for obtaining coal seam gas parameter according to claim 1, wherein: the drill pipe is rotated for 1-2 cycles at a low speed in order to achieve a better sealing elect during the time when the high pressure water enters into the borehole sealing capsule (2).

3. The measuring method according to claim 1, wherein: the power supply is recharged or the power supply module is replaced before the measurement for the additional borehole is commenced.

* * * * *